United States Patent [19]

Hansen

[11] Patent Number: 5,012,930

[45] Date of Patent: May 7, 1991

[54] ONE-PIECE, SELF-LOCKING COMPUTER SOFTWARE CONTAINER

[75] Inventor: Gerald M. Hansen, Maumee, Ohio

[73] Assignee: Nekoosa Packaging Corporation, Atlanta, Ga.

[21] Appl. No.: 495,407

[22] Filed: Mar. 19, 1990

[51] Int. Cl.[5] ..... B65D 5/54

[52] U.S. Cl. ..... 206/620; 206/628; 229/152; 229/153

[58] Field of Search ..... 206/620, 628, 44 R; 229/152, 153

[56] References Cited

U.S. PATENT DOCUMENTS

| | | | |
|---|---|---|---|
| 1,103,708 | 7/1914 | Thumb | 229/153 |
| **1,888,818** | **11/1922** | Daller | 229/153 |
| 2,153,340 | 3/1930 | Reid | 229/152 |
| 2,249,244 | 9/1938 | Guyer | 229/152 |
| 2,547,892 | 4/1951 | Stevens | 206/620 |
| 2,577,007 | 6/1947 | Dubilier . | |
| 3,785,478 | 1/1974 | Drori | 206/45.31 |
| 3,835,988 | 9/1974 | Buttery | 206/628 |
| 3,843,040 | 10/1974 | Locke . | |
| 4,381,071 | 4/1983 | Vergiels . | |
| 4,511,043 | 4/1985 | Roccaforte | 206/620 |
| 4,681,226 | 7/1987 | Pretre | 206/449 |

FOREIGN PATENT DOCUMENTS

| | | | |
|---|---|---|---|
| 399210 | 6/1909 | France | 229/152 |
| 12328 | 8/1910 | France | 229/152 |
| 1117581 | 5/1956 | France | 229/152 |
| 447156 | 5/1936 | United Kingdom | 229/152 |

*Primary Examiner*—Gary E. Elkins

*Attorney, Agent, or Firm*—Thomas A. Meehan

[57] ABSTRACT

A die cut blank of corrugated paperboard for forming a one-piece self-locking container for a product such as computer software items. Five panels forming the top, bottom and sides of the container are in line and flaps depend from either side of one of the side forming panel and each of the top and bottom forming panels. The flaps on the side forming panel include hinged locking flaps and the flaps on the top and bottom forming panels fold inwardly; the side flaps folding around them and being locked in place by the fifth panel engaging the locking flaps. The fold line for the flaps along one side of the blank are formed by serrated score lines rupturable for removal of the one end of the container providing a self supporting file holder for the software packet. A serrated thumb hole score is provided adjacent the fold line at the top (or bottom) of the container as access to enable tearing open and removal of the one end of the container. After first opening, the container is reused as a storage case for the product.

16 Claims, 3 Drawing Sheets

ONE-PIECE, SELF-LOCKING COMPUTER SOFTWARE CONTAINER

The present invention relates to corrugated paperboard containers, and more particularly, to a one-piece container formed of die-cut foldable corrugated paperboard with a readily removable end wall. This invention provides a container constructed of corrugated paperboard that is especially adapted to package and to store computer software items.

BACKGROUND OF THE INVENTION

The packages and containers for computer software that is impressed on discs, floppy discs or like media is typically packaged in a solid fiber board holder. Packages of this type are of relatively high cost, both in the container and the master shipper carton currently used.

Packaging computer software requires some durability and cushioning. Also, the container should be usable upon opening for storing and shelving the computer software and items related thereto, such as manuals and the like.

SUMMARY OF THE INVENTION

It is an object of this invention to provide a one-piece die cut container of corrugated paperboard for packaging and storing computer software or like items suitable for their safe transportation, storage and display.

Another object of the invention is to provide such a container that includes a rectangular self-locking panel and self-locking end flaps, and thereby obviate the need for a manufacturer's joint in the container, as is typically used for containers of this type.

Still another object of the invention is to provide serrated scores at the hinge line of the flaps forming one end wall of the container for removal and easy access to the container contents, and upon removal provide a storage container for the contents in a box that is open at its one end.

Yet another object of the invention is to provide a scored tab for finger access in opening the carton along the serrated end thereof, whereby tearing the flaps from the one end of the container provides easy access to the contents. After the side flaps of this one end of the container are torn away, the remainder of the carton forms a permanent holder and protector for the enclosed contents, i.e., the computer software, allowing the placement of the carton and contents in a bookcase or similar storage; yet providing easy access to the same.

Other features, objects and advantages may be derived from the invention as may be apparent from the drawings and the described embodiment of the invention.

DESCRIPTION OF A PREFERRED EMBODIMENT

Figure 1:
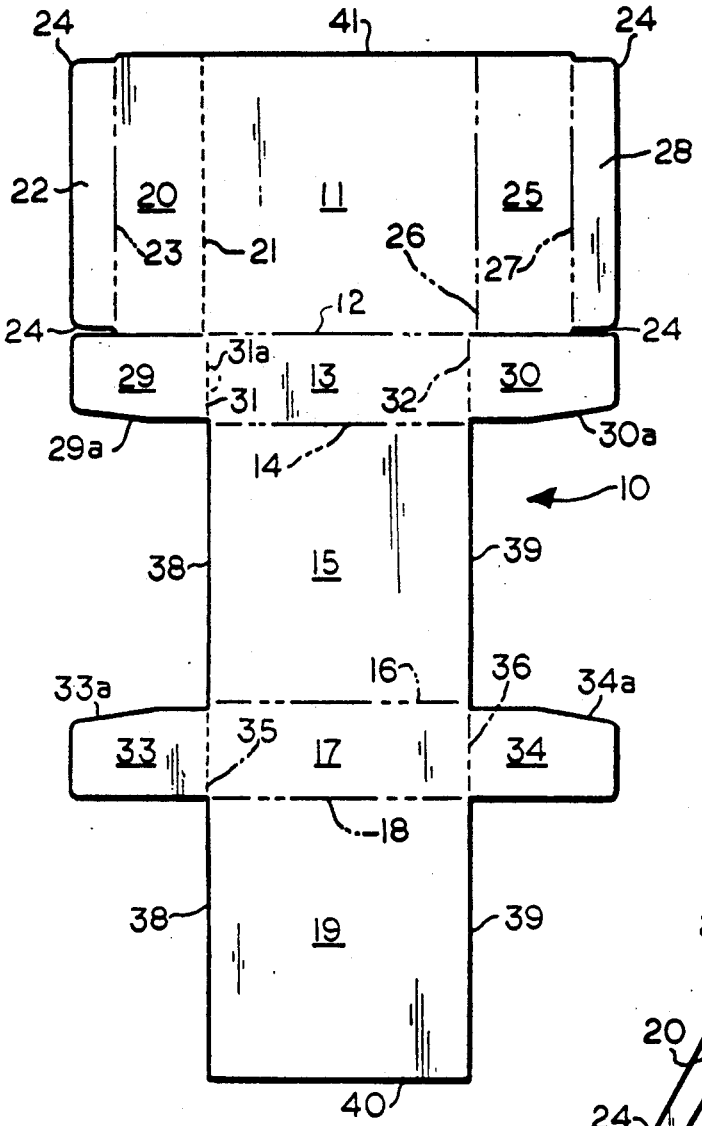
FIG. 1 is a plan view of the one-piece blank from which the container of this invention is formed.
Figure 2:
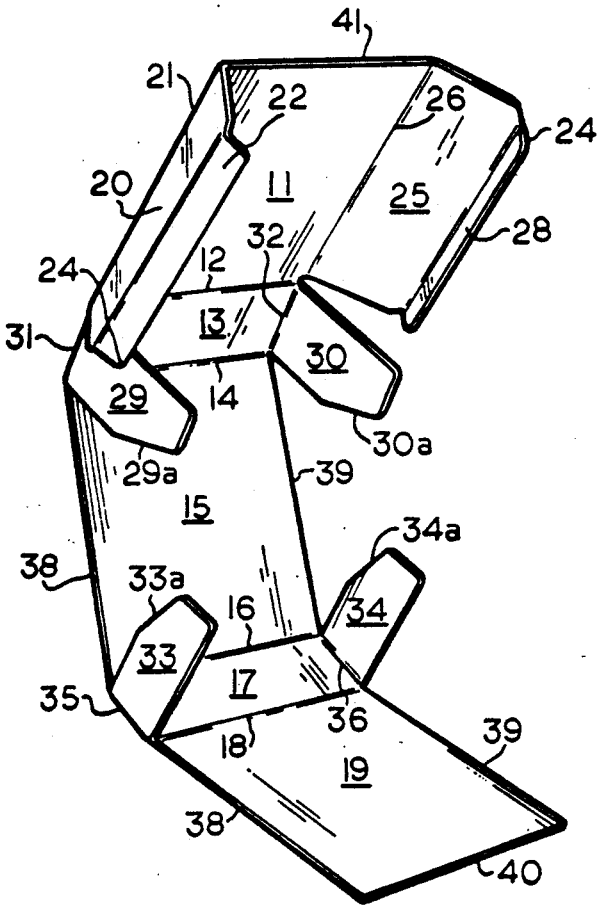
FIG. 2 is a three quarter front perspective view of the blank of FIG. 1 being assembled into a container.

Referring to FIG. 1, a die cut blank 10 of corrugated paperboard is made from a sheet of material, such as 200 weight, B-flute corrugated paperboard. The linerboard (paper) on the exterior surface of the blank after it is folded into a container, as will be described hereinafter, is comprised of a preprinted and predecorated stock. For example, a clay surfaced linerboard paper stock is first run through a printer to provide surface decoration and user information on the linerboard which is thereafter used as one of the facings of the double faced corrugated paperboard. The double faced corrugated has its other facing provided with the usual kraft linerboard. The corrugated sheet is placed in the die cutting machine to blank out the one-piece blank 10 that is used in making the container.

Although the blank 10 is preferably made with custom finished linerboard on the exterior of the corrugated, a conventional corrugated with kraft double facings may also be used to form the blank; and, as the job requires, the corrugated blank is formed and printed in line with forming the scores, hinge lines and perforations that go into the finished blank 10 as it appears on FIG. 1. Blank 10 is comprised of five panels that lie end-to-end and are joined together at crushed transverse hinge lines. Exterior side panel 11 is joined at hinge line 12 along one side to top panel 13. The opposite side of top panel 13 is joined at hinge line 14 to the opposite side panel 15. At the opposite end of panel 15 is a hinge line 16 connected to bottom panel 17 which is hingedly connected along a fold line 18 to a fifth panel 19 that is folded to lie adjacent side panel 11 and be positioned interiorly of the container.

The exterior side panel 11 is greater (by about ¼ inch) in its width dimension between fold lines 21 and 26 than is the width dimension of the panels 15 and 19 between their opposite longitudinal edges 38 and 39. Also, the longitudinal dimension of the panel 15 is greater between fold lines 14 and 16 (by about ½ inch) than the longitudinal dimension of panel 19 between fold line 18 and its edge 40 defining the free end thereof. The longitudinal dimension of panel 11 between edge 41 and fold line 12 is slightly less (by about ⅜ inch) than the longitudinal dimension of panel 15 between fold lines 14 and 16. Similarly, the dimension between fold lines 12 and 14 of the end panel 13 is substantially the same as the dimension between fold lines 16 and 18 of the other end panel 17. It is preferred the longitudinal dimension of fifth panel 19 be shorter (by about ⅛ to ¼ inch) than the panel 11 which it lies against when the blank 10 is folded into a container such that the free edge 40 of panel 19 will butt up against the inside of the end panel 13.

The exterior side panel 11 has left hand side flap 20 connected to it at hinge line 21 that is formed by a serrated score. The side flap 20 will provide one end wall of the container that is removable. A locking flap 22 is hingedly attached at the other side of flap 20 at a fold line 23 that is parallel to the perforated hinge line 21. The locking flap 22 is slightly less in its longitudinal dimension than the length of side flap 20 and is rounded at the outer corners at a radius 24. A right hand side flap 25 is hingedly attached to the side panel 11 along a fold line 26 which is a more durable crushed score to form a hinge. The other side of flap 25 is defined at a fold line 27 parallel to fold line 26 to which an integral locking flap 28 is secured. The flap 28 is constructed the same dimensionally as flap 22.

Figure 4:
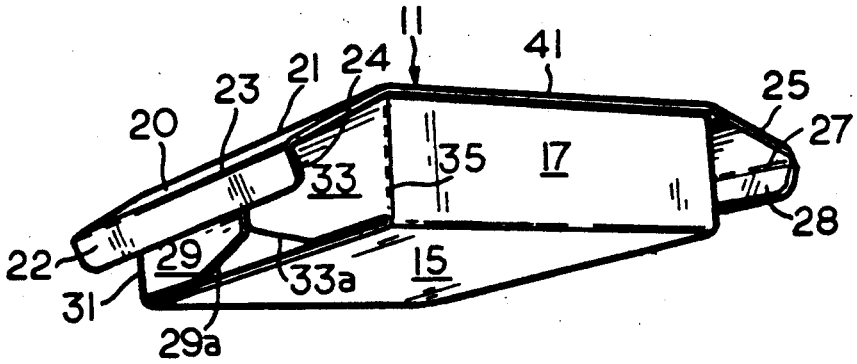
FIG. 4 is a perspective view, similar to FIGS. 2 and 3, showing the container nearer full assembly as it is being closed.
Figure 5:
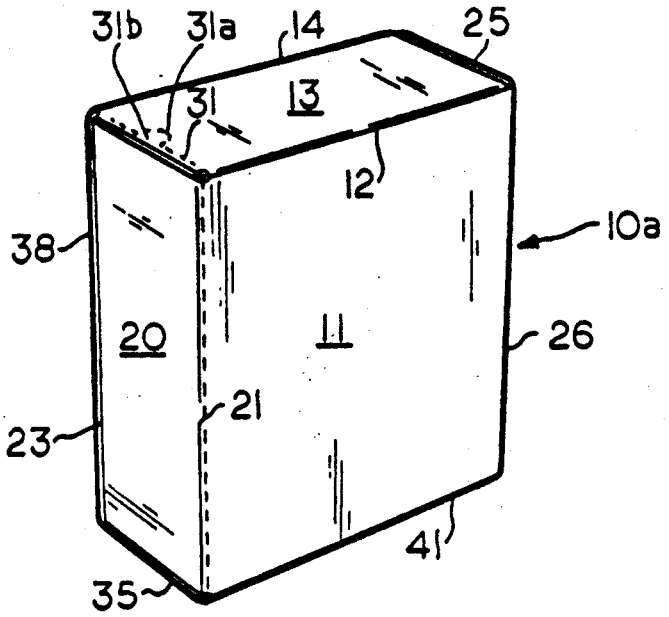
FIG. 5 is a perspective view of the box of FIG. 4 as it appears when fully assembled and closed.

The top panel 13 has flaps 29 and 30 hingedly attached to its opposite sides. The flaps 29 and 30 are of lesser width than the width of top panel 13. The hinge at 31 along the left hand side of top panel 13 is a serrated score line that includes a semicircular tab forming portion 31*a*. Flap 29 is folded along straight line 31 and the tab score 31*a* remains in the top panel 13 as a finger tab knockout portion rupturable along line 31*a* and which may be pushed and folded inwardly to provide for opening the container in a manner to be presently described. Flap 30 is hingedly attached to the opposite end of top panel 3 along the crushed hinge 32. The flaps 29 and 30 are similarly formed with one side that is inwardly tapered such that the free outer end of the flap is of lesser dimension than the dimension at the opposite end at the hinge line 31 and 32, respectively. This construction permits folding the locking flaps 22 and 28 between the panel 15 and the flaps 29, 30, as is apparent on FIG. 4.

Figure 3:
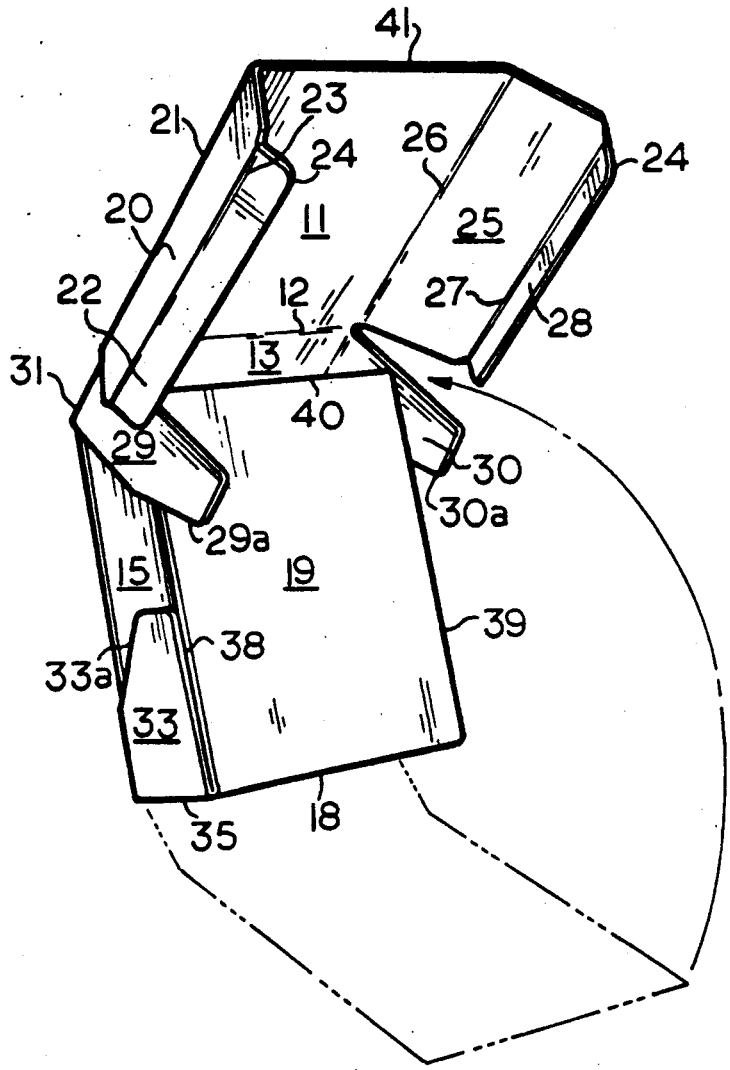
FIG. 3 is a perspective view, similar to FIG. 2, showing a further stage of assembly of the container.

A pair of flaps 33 and 34 are hingedly attached to the opposite extremities of bottom panel 17. The bottom panel 17 forms the bottom wall of the container opposite the top wall 13. The hinge at the left hand side of panel 17 (FIG. 1) is a serrated score line 35 for flap 33; whereas the opposite fold line 36 is a crushed score line for folding the flap 34 inwardly. In the alternative, the serrated score line 35 may be formed the same as the score line 31, 31*a* to include the semicircular knockout (not shown) at this bottom wall of the container, thereby allowing easy opening access at either the top or bottom wall of the container. The flaps 33 and 34 are mirror images of flaps 29 and 30, and are tapered inwardly somewhat near their outer free ends opposite the respective fold lines 35 and 36. Flaps 33 and 34 are also of lesser width than the width of bottom panel 17. When the flaps 29 and 33 are folded inwardly and perpendicular to the top and bottom panels 13 and 17, respectively, to which they are connected, the tapered sides 29*a* and 33*a* are brought adjacent the edge 38 of panel 15. (See FIGS. 3 and 4). The flaps 29 and 33 being slightly narrower in dimension than the top panel 13 between fold lines 12, 14 and bottom panel 17 between fold lines 16, 18. There results from these dimensional differences a slot or space into which the locking flap 22 is inserted and held by frictional engagement by the flaps 29, 33 and the side panel 15. (See FIG. 4.)

The same construction of flaps 30, 34 permits locking flap 28 to be inserted and held between flaps, 30, 34 and the side panel 15.

Referring to FIGS. 2–5, the blank 10 is shown folded and assembled into a closed container 10*a*. The blank 10 is first folded inwardly at the fold lines 14 and 16 and the flaps 20, 25, 29, 30 and 33, 34 are folded inwardly about their fold lines. The inner panel 19 is folded interiorly of the box, as is best seen on FIG. 3. Thereafter the outer panel 11 is folded to overlie panel 19 and abut the same. This defines the top and bottom walls of the container at the panels 13 and 17. It should be noted that panels 15 and 19 are the same width and panel 11 is slightly wider than panels 15 and 19. This geometry places fold lines 21 and 26 just outside the opposite side edges 38 and 39 of panel 19. With the flaps 29, 33 and 30, 34 folded inwardly, as indicated on FIGS. 3 and 4, the side flaps 20 and 25 are next folded inwardly. The locking flap 22 is folded and tucked under the space along the tapering edge of the flaps 29 and 33. Locking flap 28 is similarly folded and tucked under flaps 30 and 34. The closed container 10*a* is thus formed, as is seen on FIG. 5.

Figure 6:
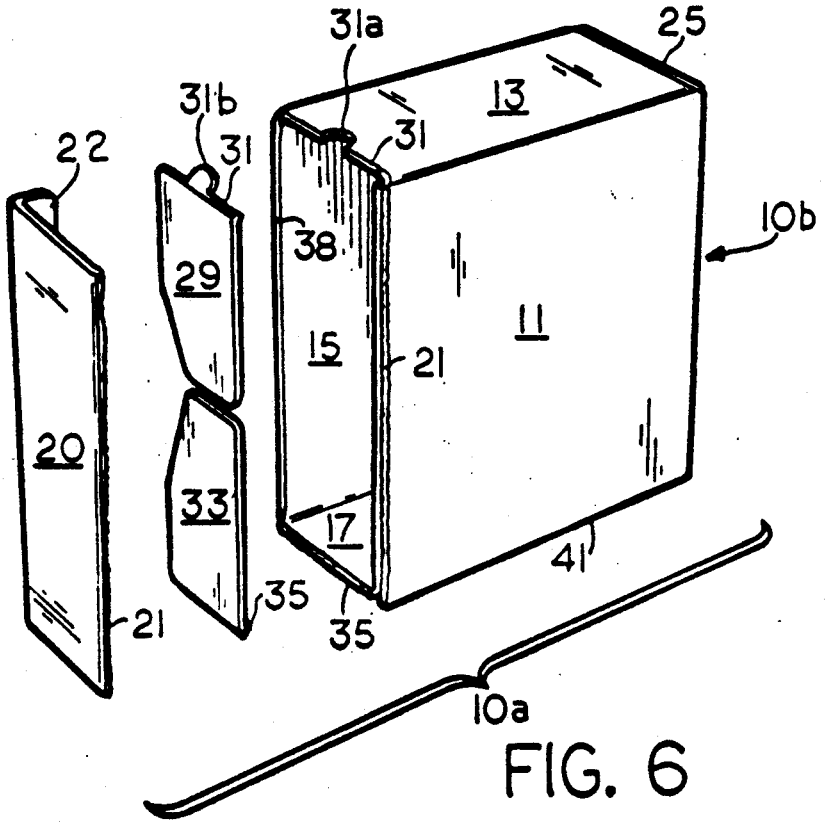
FIG. 6 is a spacial perspective view of the carton of FIG. 5 showing the one end wall torn away along the perforations of the multiple flaps leaving a case for storage of the contents on a book shelf with the one end open and exposed for viewing the contents.

The serrated edges at lines 21, 31, 31*a* and 35 provide an easy opening means for container 10*a*. By pressing a thumb or instrument against the tab 31*b* formed by serrated score 31*a*, the corrugated is torn along the semicircular outline. (See FIG. 6.) This is sized to accommodate the thumb. Pulling outwardly from the thumb hole left by the separated and inwardly folded tab 31*b*, the side of the container is opened by severing along the serrated score lines 35, 31, 21 and removing the flaps 29 and 33 and the end flap 20 and its locking flap 22, the latter two flaps remaining connected. The resulting box, indicated as 10*b*, now provides a storage case for shelving the software contents on a book shelf or other storage facility. The other end wall 25 of the box remains intact held by the locking flap 28 tucked in between the edges of the flaps 30, 34 and panel 15. The resulting storage box 10*b* is a corrugated case that is strong and durable for use in retaining the software package contents originally packaged in the container 10*a*.

From the foregoing embodiment there is provided a one-piece, die cut container of corrugated paperboard that is suitable for safe packaging and handling of the software components. Upon opening the package by rupturing the corrugated wall of the end portion along the serrated score lines there is provided a storage case, open at one end, for housing the software components, manual, etc. The design of the blank includes a fifth panel which provides a locking panel for holding the locking tabs in self-locking position; and, accordingly, the container precludes the need for a manufacturer's joint, and precludes a need for gluing, stapling or similar fabrication elements as are typically used in such a container. The use of the rupturable score lines at the one end of the container provides easy access to opening and removal of the contents. The removal of the one end wall by rupturing at the serrations creates a holder and carrying case for the computer software contents allowing for placement of the package and contents in a bookcase and yet having easy access to same for use. The locking flaps at the other end wall of the container remain in place held by the fifth panel and maintain the package as a storage case unit. The cost of this construction presents a substantial saving over prior container and case designs in use. The assembly of the container, filling and closing same, represents a further cost saving to the customer in marketing its software. Currently, software packages utilize a master shipper for a group of software packages, however, due to the added strength of the corrugated paperboard construction of the invention, the master shipper carton is no longer necessary. It is estimated the cost ratio of the prior art container to the present invention is on the order of 6 to 1.

It will be understood that the foregoing description of an illustrative embodiment will permit others to conceive of modifications of the invention. Accordingly, the scope of the invention is to be determined from the appended claims.

What is claimed is:

1. A one-piece blank of corrugated paperboard for a container, the one-piece blank comprising:

five panels disposed longitudinally end-to-end and connected to each other at parallel, lateral fold lines, the first and third panels forming external sidewalls of the container and the second and fourth panels forming top and bottom walls thereof, laterally extending integral side flaps connected on opposite sides of said first panel and foldable along parallel longitudinal first fold lines, one of said side flaps being adapted to form one end wall of the container, and the other side flap being adapted to form the opposite other end wall of the container, the first panel being slightly greater in its width dimension between said parallel longitudinal first fold lines than the width dimension of the third and fifth panels, locking flaps extending laterally from said side flaps and connected thereto along longitudinal second fold lines, the fifth panel being hingedly connected to said fourth panel and having a free lateral edge, said fifth panel being folded to lie in underlying relationship to said first panel, and its free lateral edge abutting said second panel, laterally extending flaps hingedly connected to one side of the second and fourth panels and to the other side of the second and fourth panels, said laterally extending flaps being inwardly foldable so that one edge of each laterally extending flap is adapted to lie adjacent said fifth panel and the other parallel edge of each flap lies adjacent the third panel, and said locking flaps being foldable inwardly and held between said other edge of said lateral flaps of the second and fourth panels and said third panel, to thereby close the opposite ends of the container.

2. The one-piece blank of claim 1 wherein the first and fifth panels are of substantially the same length.

3. The one-piece blank of claim 1 wherein the first fold line of said one side flap connected along one side of the first panel is serrated and rupturable for tear removal of said one side flap.

4. The one-piece blank of claim 3 wherein the laterally extending flaps are hingedly connected along the one side of the second and fourth panels respectively at serrated score lines that are rupturable for tear removal of said one side flaps.

5. The one-piece blank of claim 4 wherein the serrated score line of one of said second and fourth panels includes a semicircular serrated score in one of said panels defining a rupturable thumb tab operable for gripping and opening the end wall of the container thereat.

6. The one-piece blank of claim 2 wherein each of the laterally extending flaps on the second and fourth panels is tapered on one edge at the end not connected to the second and fourth panels toward their free for receiving the locking flaps between the tapered edge and the third panel.

7. A rectilinear container for articles of computer software or generally square shaped objects, said container having unitary construction of corrugated paperboard comprised of opposite end walls, top and bottom walls and opposite side walls, each said end wall being hingedly connected at one edge to one of the side walls at a fold line and including a locking flap hingedly connected at the other edge of each end wall, said one side wall being a two ply with the one side wall that is connected to the end walls forming the outer ply and the inner ply being formed from a third side panel, said top and bottom walls, the other side wall and an inner ply of the one side wall having a common dimension that is less than the width of the outer ply of said one side wall, the outer ply of the one side wall having end flaps connected on opposite sides along first and second hinge lines about which the flaps are folded to form end walls of the container, and said locking flap on each of the end flaps engaging inside of the other side wall holding its associated end flap in place as the end wall of the container.

8. The container of claim 7 in which one of the end walls is hingedly connected to said one side wall along a serrated scored line that is rupturable for removing the said one of the end walls of the container.

9. The container of claim 8 in which the corrugated paperboard of the container is comprised of double faced corrugated paperboard material, the outer face of said material is a preprinted linerboard.

10. The container of claim 8 in which the bottom wall includes laterally extending flaps, each flap hingedly connected thereto at either end of said bottom wall along a fold line and the top wall includes laterally extending flaps, each flap hingedly connected thereto at either end of said top wall along a fold line, said bottom wall and top wall flaps being folded inwardly of the container and covered by the end walls, and said locking flap of each of the end walls is placed between and engaging the said other side wall and two of the laterally extending flaps.

11. The container of claim 10 in which the fold lines of each of the flaps on the top wall and the bottom wall that are adjacent said one end wall of the container are serrated score lines, said one top wall lateral flap and one bottom wall lateral flap being removable upon opening the container by rupturing along said serrated score line.

12. The container of claim 11 which includes a thumb tab outlined by a serrated score line in the top wall of the container adjacent said one top wall lateral flap, said thumb tap portion of the top wall being rupturable to provide a thumb hole for removing said one end wall of the container and said one top wall lateral flap by tearing both walls along its associated score lines.

13. A rectilinear container having six sides comprised of a top panel, bottom panel and opposite side forming panels connected to each other along lateral fold lines and two end forming flaps connected to one side forming panel along longitudinal fold lines on either side of said one side forming panel, said end forming flaps defining opposite ends of the container, a fifth panel connected to said bottom panel along a lateral fold line and lying adjacent said one side forming panel when disposed interiorly of the container, a locking flap connected to each of said end forming flaps along a longitudinal fold line, said locking flap being foldable inwardly and secured interiorly of the container, said one side forming panel being slightly greater in its width dimension between said longitudinal fold lines than the dimension of the other side forming panel and said fifth panel, one of the end forming flaps being rupturable along its longitudinal fold line for selective removal whereupon the other end forming flap is secured interiorly to provide a storage container that is open at the said one end.

14. The container of claim 13 which includes lateral flaps connected to each side of both the bottom and top forming panels folded inwardly to engage an edge of said fifth panel interiorly of the container, said lateral flaps holding the locking flap of each of the end forming flaps against the other side forming panel and retaining the ends closed.

15. The container of claim 14 in which the rupturable end forming flap is connected to said one side forming panel by a serrated score.

16. The container of claim 15 in which the lateral flaps connected to the bottom and top forming panels on the side of said bottom and top panels which corresponds to the rupturable end forming flap are connected along a serrated score for ease of removal upon removal of said rupturable end forming flap.

* * * * *